US009688430B2

(12) United States Patent
Zambelli

(10) Patent No.: US 9,688,430 B2
(45) Date of Patent: Jun. 27, 2017

(54) EQUIPMENT FOR CONTINUOUSLY FEEDING BOXES OR CONTAINERS STACKED IN A FLAT TUBULAR CONFIGURATION TO A PACKAGING MACHINE WHICH ALSO OPERATES CONTINUOUSLY

(75) Inventor: Flavio Zambelli, San Pietro In Casale (IT)

(73) Assignee: ZAMBELLI S.R.L., San Pietro In Casale (BO) (IT)

( * ) Notice: Subject to any disclaimer, the term of this patent is extended or adjusted under 35 U.S.C. 154(b) by 1126 days.

(21) Appl. No.: 13/819,465

(22) PCT Filed: Aug. 11, 2011

(86) PCT No.: PCT/EP2011/063870

§ 371 (c)(1),
(2), (4) Date: Feb. 27, 2013

(87) PCT Pub. No.: WO2012/028436

PCT Pub. Date: Mar. 8, 2012

(65) Prior Publication Data

US 2013/0160402 A1 Jun. 27, 2013

(30) Foreign Application Priority Data

Aug. 31, 2010 (IT) ..... BO2010A0533

(51) Int. Cl.
*B65B 43/42* (2006.01)
*B65B 43/18* (2006.01)
*B65B 43/32* (2006.01)

(52) U.S. Cl.
CPC ..... *B65B 43/185* (2013.01); *B65B 43/325* (2013.01); *B65B 43/42* (2013.01)

(58) Field of Classification Search
CPC ..... B65B 43/42; B65B 43/185; B65B 43/325
(Continued)

(56) References Cited

U.S. PATENT DOCUMENTS 4,871,348 A 10/1989 Konaka
5,061,231 A * 10/1991 Dietrich ..... B65B 43/265 271/95

(Continued)

FOREIGN PATENT DOCUMENTS

GB 2 053 133 2/1981

OTHER PUBLICATIONS

International Search Report for PCT/EP2011/063870 dated Nov. 17, 2011.

(Continued)

*Primary Examiner* — Thanh Truong
*Assistant Examiner* — Thomas Wittenschlaeger
(74) *Attorney, Agent, or Firm* — Stetina Brunda Garred and Brucker

(57) ABSTRACT

Equipment for feeding containers to a packaging machine comprising a magazine containing stacked containers. The equipment comprising a carousel device for collecting and inserting the containers into a conveyor. The magazine is positioned with its lower end slightly above that of the conveyor and suitably upstream thereof, in that a carousel device, rotating about a horizontal axis orthogonal to the direction of continuous advance of the upper run of the conveyor of the packaging machine, is located under the magazine and upstream of the conveyor, in that this carousel device comprises a plurality of suction cup units positioned in a way determined by interaction with cams, and in that the units are designed to grip the container and draw it from the base of the store by gripping the base wall by means of which these units subsequently deposit the container in a dynamic way on to the conveyor.

6 Claims, 3 Drawing Sheets

(58) Field of Classification Search
USPC ..... 53/381.1; 493/313, 309, 311, 314, 315, 493/316, 317, 318, 319
See application file for complete search history.

(56) References Cited

U.S. PATENT DOCUMENTS

| | | | | |
|---|---|---|---|---|
| 5,102,385 | A | 4/1992 | Calvert | |
| 5,104,369 | A * | 4/1992 | Calvert | B65B 43/265 493/315 |
| 5,715,657 | A * | 2/1998 | Mondani | B31B 5/80 493/313 |
| 7,316,642 | B2 | 1/2008 | Martelli | |
| 7,695,421 | B2 * | 4/2010 | Ford | B65B 43/185 271/100 |
| 7,976,449 | B2 * | 7/2011 | Klein | B31B 1/80 493/309 |
| 2008/0227612 | A1 * | 9/2008 | Harston | B65B 43/185 493/315 |

OTHER PUBLICATIONS

Written Opinion of the International Searching Authority for PCT/EP2011/063870 dated Nov. 17, 2011.

* cited by examiner

EQUIPMENT FOR CONTINUOUSLY FEEDING BOXES OR CONTAINERS STACKED IN A FLAT TUBULAR CONFIGURATION TO A PACKAGING MACHINE WHICH ALSO OPERATES CONTINUOUSLY

BACKGROUND

The invention relates to equipment for continuously feeding boxes or containers, which are initially stacked in a flattened tubular configuration in the form in which they are received from a paper products factory, to a packaging machine which is, for example, of the straight-line or other continuously operating type. The most similar prior art to the equipment described here is represented by the international patent application WO 1992/015450 entitled "Feeder mechanism for sleeve type cartons" and European patent EP 1 597 150 granted on May 14, 2008, entitled "Apparatus for forming containers". The first of these patents describes equipment for feeding containers to the cellular conveyor of a packaging machine, in which the magazine holding the stacked containers is downwardly open and is located above the initial part of the cellular conveyor, with a carousel located between these two components and having a horizontal axis orthogonal to the direction of operation of the cellular conveyor, a plurality of suction cup pick-up units being mounted on the carousel in a radial arrangement with equal angular intervals between them, and being positioned in a way which is controlled by cams. The carousel rotates in phase with the conveyor of the packaging machine and moves each of its pick-up units in sequence in order to grip a container, draw it out of the base of the magazine, move it downwards, interact with an opening means, and, after a rotation of about 180°, insert the substantially open container at the correct time into a cell being formed in the initial part of the underlying conveyor, the container being supported by the wall opposite that with which the container touches the base of the cell. The equipment therefore requires extremely complicated, time-consuming, difficult and costly adjustments whenever the format of the containers is changed. It is also difficult to adjust the equipment in order to avoid damage to the container during its transfer to the conveyor of the packaging machine, each cell of which must always be positioned so that it is open at the rear and must then be closed on the container which has been fed into it. Furthermore, the height of this equipment is considerable, making it necessary to position the container magazine at a very high level, creating difficulties in the cyclic restocking and in the control of operation. However, the equipment is capable of operating continuously at high speed.

The equipment described in the second of the aforementioned patents partially overcomes the drawbacks of the first equipment, in that it enables the magazine to be positioned at a very low level and the containers are inserted into the cells of the packaging conveyor with their lower walls retained by the same means as those used to extract the containers from the feed magazine. The container feed means are therefore required to move between two "zero" reference positions, namely the base of the feed magazine and the base of the cells, which do not change when the format of the containers changes, and consequently the procedure for adapting the equipment to the changes in format is considerably simplified. In particular, the containers are drawn, one at a time, from the base of the magazine by a suction cup arm which initially swings downwards and then extends towards the initial part of the cellular conveyor of the packaging machine, where opening means operate at the correct time to open the container so that the latter can be inserted at the correct time into the cell which is open at the rear and which is being formed in the initial part of the conveyor. After the feed step, the suction cup arm releases the container, is lowered, is retracted under the magazine, and is then raised again to repeat the cycle which has been described. Clearly, equipment of this type has long periods of downtime and cannot operate at a speed as high as that of the carousel device described in the first of the cited patents. This equipment is subject to the same problems of adjustment as the first, for the purpose of avoiding damage to the container during its transfer to the conveyor of the packaging machine, each cell of which must always be positioned so that it is open at the rear and must then be closed on the container which has been fed into it.

BRIEF SUMMARY OF THE INVENTION

The invention proposes equipment for feeding boxes or containers, initially stacked in a flattened configuration, to the conveyor of a packaging machine, this equipment having the advantages of the aforesaid known equipment, but being free of their drawbacks, in that it can operate continuously at high speed, requires no complicated adjustment when the format of the containers changes, can insert the containers into cells which are already substantially formed, and allows the magazine to be positioned at a low level where it can easily be restocked and inspected. The innovative characteristics of the equipment according to the invention will be apparent from the following description of a preferred embodiment of the invention, illustrated purely by way of non-limiting example in the figures on the three attached sheets of drawing.

DETAILED DESCRIPTION

Figure 1:
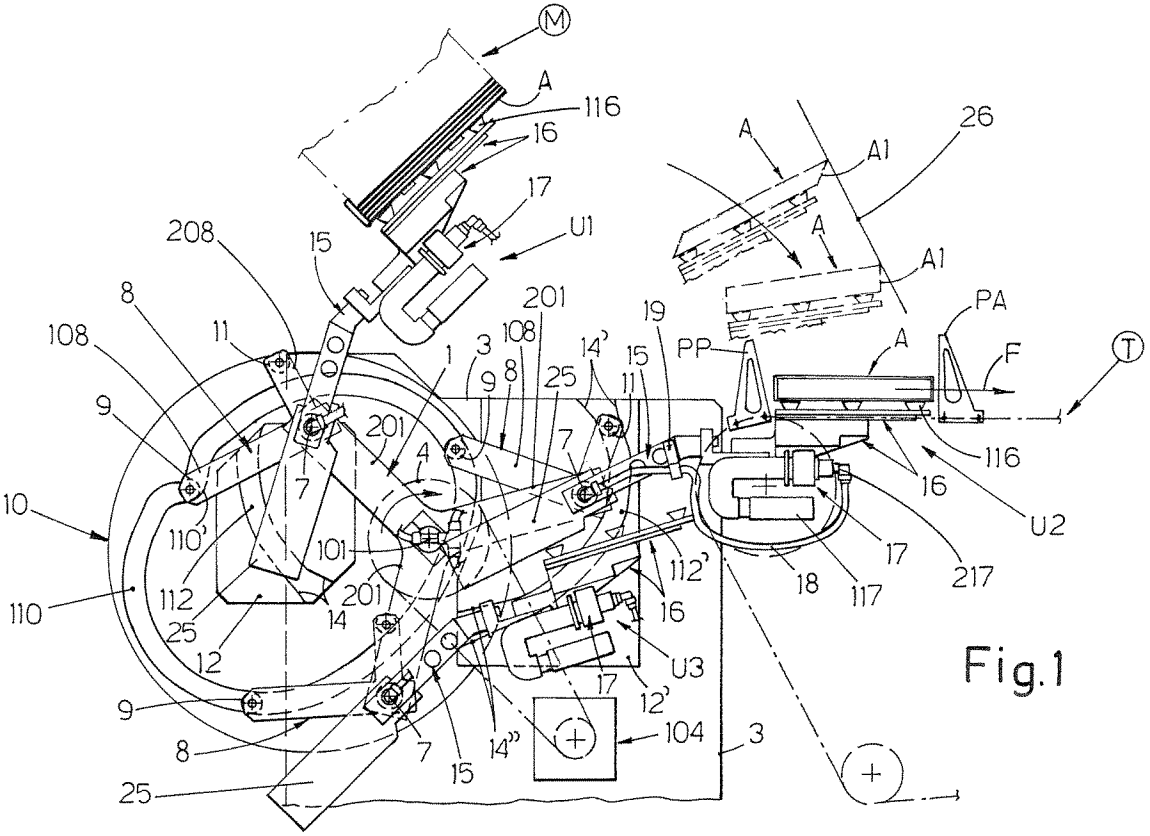
FIGS. 1 and 2 show the equipment, respectively, in a schematic view and in lateral elevation with a degree of perspective, viewed in both cases from the same side of the container pick-up and feed members.

In the drawings, the letter M indicates the magazine of a known type in which the containers A in a flattened tubular configuration are stacked, with one of the two open ends facing the viewer of FIG. 1, this magazine having its lower end facing downwards with an inclination of about 45° for example. The base of the magazine M is placed slightly upstream of, and at a slightly higher level than, the base of the active run of the cellular conveyor T of the packaging machine which operates continuously in the direction F. The letters PA and PP indicate, respectively, the front and rear walls delimiting the cells of the conveyor T, into each of which cells a container is to be fed in the open tubular configuration, to enable a product to be inserted into the container subsequently through one of its lateral openings.

The container feed equipment is located under the magazine M, upstream of the conveyor T and substantially at the same level as the conveyor, this feed equipment comprising a carousel 1 supported by one end of a horizontal main shaft 101 which is orthogonal to the direction F of advance of the conveyor T and which is supported rotatably by a support 2 fixed to the vertical plate 3 of a base structure of greater width (not shown). The end of the shaft 101 opposite that which supports the carousel 1 is connected to a motion transmission system 4, 104 of any type which can transmit to the carousel a rotation in the clockwise direction as it appears to the viewer of FIGS. 1 and 2, this rotation being continuous and in phase with the continuous movement of the chains of the conveyor T. Preferably, the transmission system 4 transmits the motion to the shaft 101 through an interposed safety joint 5, and suitable sensors, which are not shown because they will be well-known to persons skilled in the art, are provided to transmit to the central processor of the machine electrical signals corresponding to the phase of the transmission system 4, 104 and to any difference between this and the phase of the shaft 101 when the safety joint 5 is required to operate.

A rotary distributor 6 connected to a pneumatic circuit 106, described more fully below, is mounted on the end of the shaft 101 which is closer to the transmission system 4.

Figure 2:
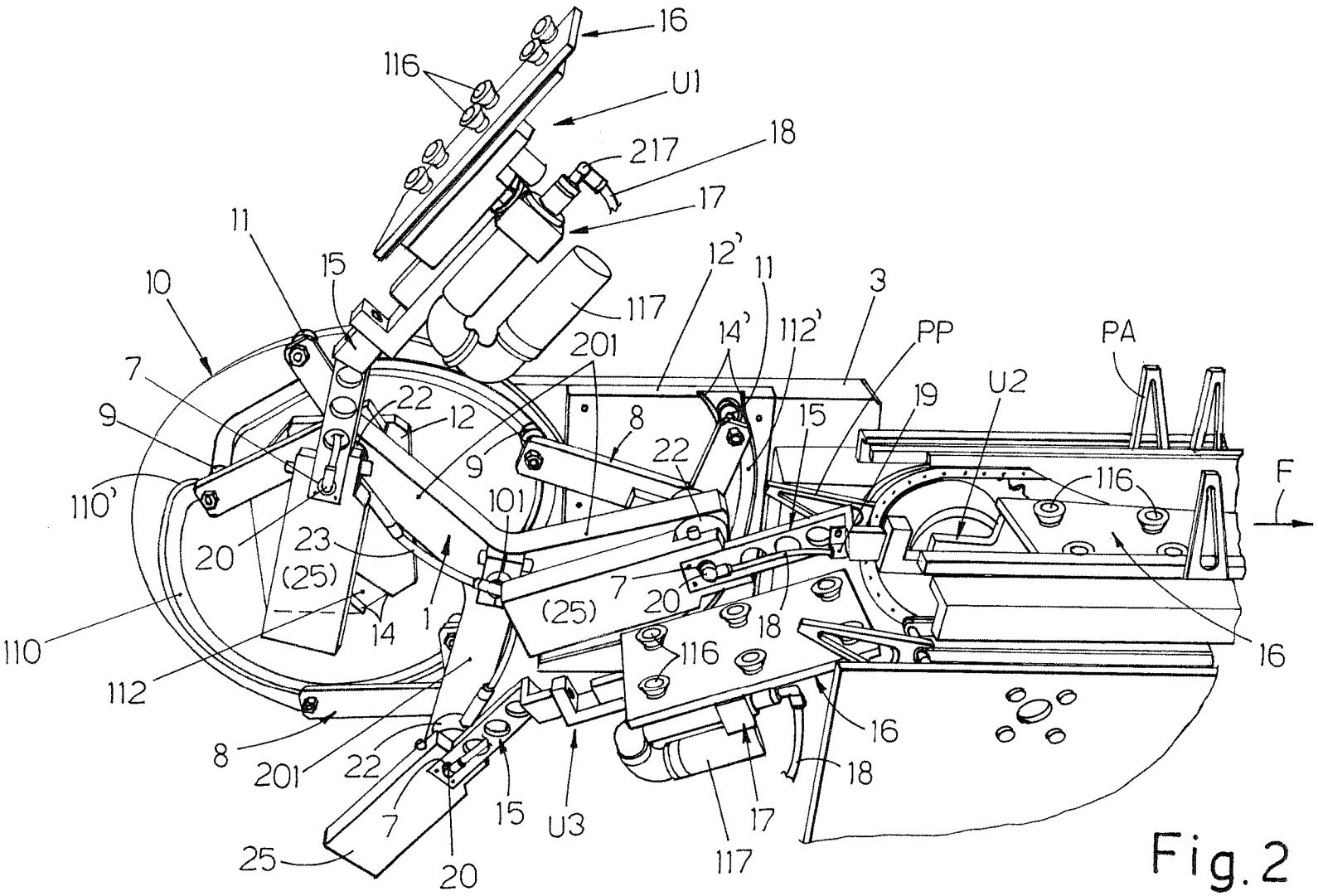
Figure 3:
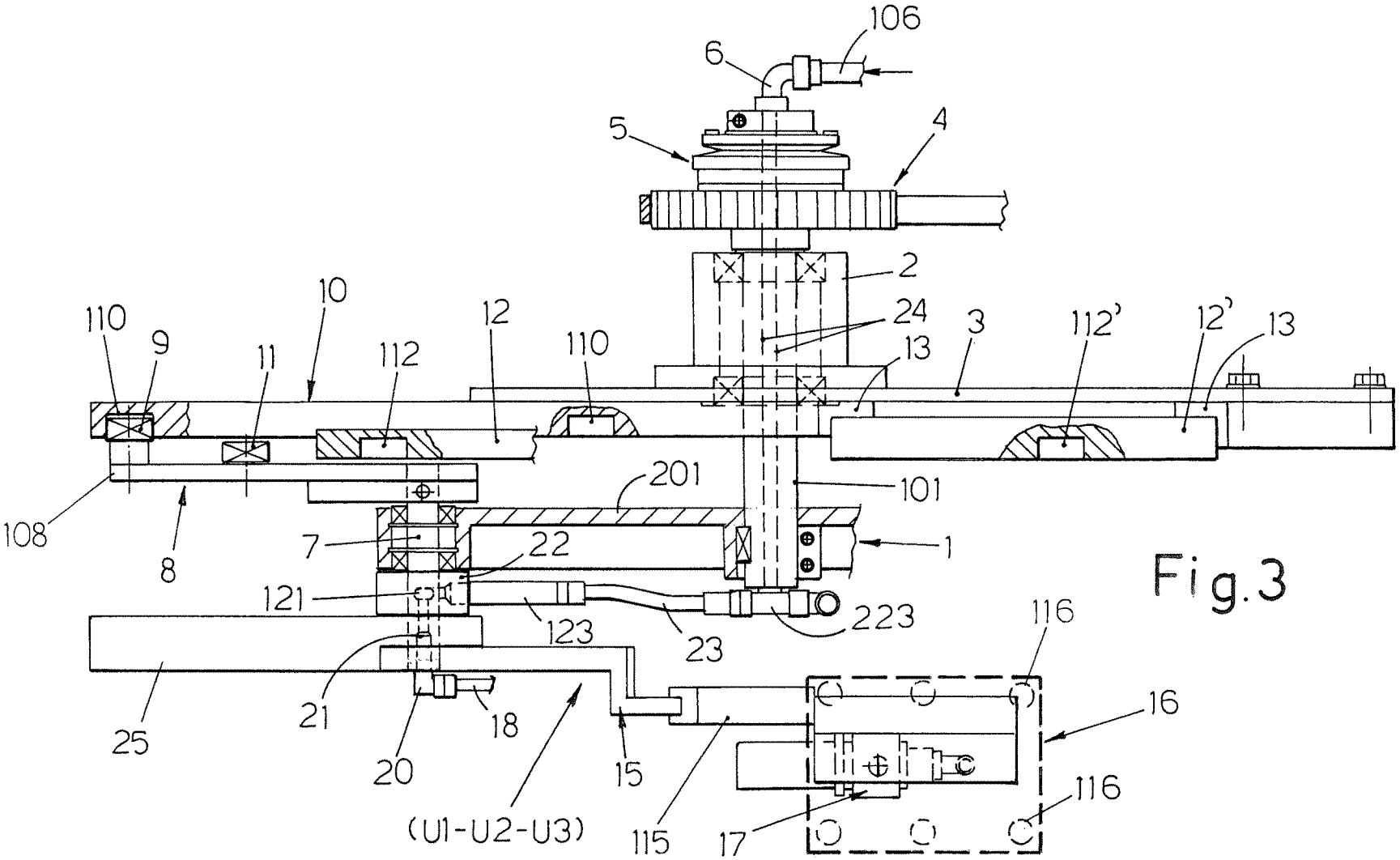
FIG. 3 shows the equipment in a plan view from above, showing a single container pick-up and transfer unit, with parts in section.

The carousel 1, which is fixed on the end of the shaft 101, is star-shaped, having for example three identical spokes 201 spaced at equal angular intervals from each other, whose distal ends rotatably support corresponding pivot pins 7 which are parallel to the shaft 101, and which project from both sides of the corresponding spokes 201, a corresponding feed unit U1, U2, U3 as described below being fixed on the end of each pivot pin. On the other end of each pin 7, which projects towards the base side member 3, there is fixed a right-angled lever 8 which has an arm of greater length 108 whose end carries, on the side facing the side member 3, a roller 9 which follows the double-acting and closed annular profile 110 of a face cam 10 fixed to the base side member 3. The profile 110, as shown in FIGS. 1 and 2, is substantially elliptical in shape, is axially offset from the shaft 101, and has an inner peak 110' on the ascending branch for the purpose described below. On the end of the shorter arm of the right-angled lever 8 there is a laterally mounted roller 11 which can follow the curved profile 112, 112' of two successive face cam sectors 12, 12' which are fixed to the cam 10 and, partially, in the case of the sector 12' only, to the base side member 3 also, with the interposition of spacers 13 (FIG. 3). At least the entry ends of the profiles 112, 112' and preferably also the exit end of the profile 112' have flared shapes 14, 14', 14" to improve the interaction with the roller 11.

An arm 15 is fixed perpendicularly to the other end of each pivot pin 7, this arm being Z-shaped in plan view in order to keep its distal end 115 at a suitable distance from the adjacent carousel 1, and this end 115 is designed in such a way that a plate 16 can be mounted on it in an adjustable and interchangeable way, the plate 16 having a shape related to that of the containers A and being provided with the correct number of suitably distributed suction cups 116, which are connected at the correct time to suction means or to the atmosphere. For example, good results have been obtained by mounting in the lower part of each plate 16, in communication with its inner cavities to which the suction cups 116 are connected, a small stationary Venturi vacuum pump 17, which has a silenced outlet filter 117 and has its inlet 217 connected to a compressed air delivery tube 18, which is supported in at least one intermediate part by a support 19 fixed to the arm 15, and whose other end is connected to a connector 20 fixed on the end of the pivot pin 7 which supports the arm 15. The connector 20 is connected to an axial cavity 21 of the pivot pin 7 which has a radial slot-like outlet 121 opening in a portion of the pin 7 on which is mounted, with the interposition of sealing means, a rotary collector 22 which is connected by means of a tube 23 with corresponding connectors 123, 223 to an axial cavity 24 of the shaft 101, which is connected at the other end of this shaft to the circuit 6, 106 which in turn is connected to a compressed air supply. By means of the circuit which has been described, the compressed air is sent to each Venturi pump 17 which converts it to a suction force acting on the suction pumps 116. The rotary collector 22 is internally shaped in such a way that, in its interaction by relative rotation with the radial slot-like outlet 121, it forms an automatic distribution chamber which, in certain specific angular positions of the carousel 1 and of each arm 15, causes the suction cups 116 of each arm to create suction or to be connected to the atmosphere (see below). In order to balance the weight of each arm 15 and the corresponding plate 16, a suitable counterweight 25 for static and dynamic balancing is fixed to the end of the pivot pin 7 which also carries the arm.

It can be seen in FIG. 1 that the equipment is designed in such a way that, while the plate 16 of one unit U1 is interacting with the magazine M, the unit U2 is interacting with the conveyor T and the unit U3 is in an intermediate position between T and M, still with the plate 16 orientated upwards. The roller 11 of the unit U3 has just ceased to interact with the profile 112' of the fixed cam sector 12', while the roller 9 is running along the lower portion of the profile 110 of the main fixed cam 10. The suction cups of the unit U3 are inactive. During the subsequent clockwise rotation of the carousel 1, the roller 11 of the unit U3 interacts with the profile 112 of the fixed cam sector 12, causing the plate 16 of this unit to swing upwards and be positioned in the required way for correct interaction with the base of the magazine M. During the travel along the ascending portion of the profile 110, before the roller 9 reaches the inner peak 110' of this profile, the roller 11 leaves the profile 112 of the cam 12, as a result of which, when the roller 9 follows the peak 110', the plate 16 with the suction cups of the unit which bears on the magazine M, which in this example is the unit U1, approaches the base of the magazine in order to pick up the base container and draw it out with an upward translational movement, while known means which are provided in the magazine come into action to retain the other containers in the stack. In this step, the suction cups 116 of the plate 16 are providing suction in order to firmly retain the container to be drawn out, and then draw it out. In the movement from the magazine M to the conveyor T, the roller 11 of the feed unit starts to interact with the profile 112' of the cam 12 and the plate 16 of this unit is inserted into the initial part of the upper run of the conveyor T, thus placing the container A in a horizontal position in the cell PA, PP which is substantially formed on this conveyor, while the suction cups of this unit are inactivated at the correct time to release the container. During the transfer from the magazine M to the conveyor T, at least one of the walls of the container held by the feed unit in transit interacts with any suitable opening means which open the container so that it can be inserted in the open state into the cell PA, PP of the conveyor T. In the present example, the front wall A1 of the container which is about to be fed on to the conveyor T interacts with an adjustable fixed guide 26 which provides the desired degree of opening of the container. When the container has been inserted into the cell of the conveyor T, the distal end of the plate 16 of the unit U2 swings downwards, thus assisting the progressive detachment of the container from the suction cups 116 which are disconnected from the vacuum at the correct time.

The invention claimed is:

1. An equipment for continuously feeding boxes or containers stacked in a flat tubular configuration to a packaging machine which also operates continuously, the equipment being of the type comprising a magazine containing the stacked containers, the stacked containers being downwardly open and located in an initial part of a cellular conveyor of the packaging machine, and comprising a carousel device for collecting the containers, one at a time, from a base of the stacked containers and for inserting them into cells of the cellular conveyor at a correct time, characterized in that the magazine is positioned with its lower end at a level slightly above that of the cellular conveyor and suitably upstream thereof, in that the carousel device, rotating about a horizontal axis orthogonal to the direction of continuous advance of an upper run of the cellular conveyor of the packaging machine, is located under the magazine and upstream of the cellular conveyor, in that the carousel device comprises a plurality of suction cup units which are spaced at equal angular intervals from each other and are positioned in a way which is determined by interaction with cams, and in that the suction cup units are designed to grip the container and draw it from the base of the stacked containers by gripping a base wall by means of which these units subsequently deposit the container in a dynamic way on to a base of the cell of the cellular conveyor, the whole being arranged in such a way as to simplify the adaptation of the equipment to changes in the format of the containers;

wherein a shaft of the carousel is supported rotatably and projectingly by a supporting side member and is connected to a motion transmission system which can transmit to the carousel a rotary movement which in its upper and descending portion passes from the magazine to the cellular conveyor and which is in phase with the continuous movement of the cellular conveyor, the carousel being characterized by a star shape having a plurality of spokes, each spoke having a distal end rotatably supporting corresponding pivot pins which are parallel to the shaft and project from both sides of the corresponding spokes, one end of each pivot pin having a corresponding container pick-up and transfer unit fixed to it, while the other end, facing the supporting side member, has a right-angled lever fixed to it having end rollers interacting, respectively, with a closed profile of a primary cam and with the profiles of successive secondary cam sectors fixed to the supporting side member, in such a way as to actively control the positioning of the pick-up and transfer units, thus ensuring that they interact correctly with the magazine initially, and with the conveyor subsequently.

2. The equipment according to claim 1, characterized in that the closed profile of the primary cam is substantially elliptical in shape, is axially offset from the shaft of the carousel and has a small inner peak on its ascending branch for imparting to the pick-up and transfer units the necessary movements for correctly drawing a container out of the base of the magazine, while the profiles of the secondary cam sectors are provided with suitable flared end portions and are designed so as to position the pick-up and transfer units correctly before their interaction with the magazine and subsequently during their interaction with the cells of the conveyor and during their departure from the latter.

3. The equipment according to claim 1, characterized in that each pick-up and transfer unit comprises an arm fixed perpendicularly on its corresponding pivot pin, this arm being Z-shaped in plan view so as to have its distal end suitably distant from the adjacent carousel, this end being designed to enable a plate to be mounted on it in a rapid, adjustable and interchangeable way, the plate having a shape related to that of the containers and being provided with the correct number of suitably distributed suction cups which are automatically connected to suction means or to the atmosphere at the correct time.

4. The equipment according to claim 3, characterized in that a small stationary Venturi vacuum pump is mounted on a lower part of each plate, in communication with its inner cavities to which the suction cups are connected, the pump being connected to a compressed air delivery tube whose other end is connected to a connector which is fixed on the end of one of the pivot pins and which is connected to an axial cavity of the pin, the cavity having a radial slot-like outlet opening in a portion of the pin on which is mounted, with the interposition of sealing means, a rotary collector which is connected by means of a tube with corresponding connectors to an axial cavity of the shaft of the carousel, which is connected at the other end of the shaft to a circuit which is connected to a compressed air supply, the whole arrangement being such that, by means of this circuit or an equivalent circuit, the compressed air reaches each Venturi pump which converts it into a suction force acting on the suction cups, the rotary collector being shaped internally in such a way that, in its interaction by relative rotation with the radial slot-like outlet of the pin, it forms an automatic distribution chamber which, in certain predetermined angular positions of the carousel and of each arm, causes the corresponding suction cups to provide suction or to be connected to the atmosphere.

5. The equipment according to claim 3, characterized in that a suitable static and dynamic balancing counterweight is fixed on the end of the pivot pin which carries the arm with the suction plate.

6. The equipment according to claim 1, characterized in that it comprises suitable opening means of the static and/or dynamic type, which open the container during its transfer from the magazine to the conveyor of the packaging machine, thus enabling the container to be inserted in an open state into the cell which is substantially formed or is in the course of formation on the conveyor.

* * * * *